United States Patent [19]

Perrot

[11] 4,077,201

[45] Mar. 7, 1978

[54] EXTRACTABLE BARREL-ARBOR

[75] Inventor: Friedrich Perrot, Lengnau, Switzerland

[73] Assignee: Eta A.G. Ebauches-Fabrik, Switzerland

[21] Appl. No.: 731,573

[22] Filed: Oct. 12, 1976

[30] Foreign Application Priority Data

Oct. 21, 1975 Switzerland ..... 13615/75

[51] Int. Cl.[2] ..... G04B 1/16; G04B 1/18; G04B 31/00

[52] U.S. Cl. ..... 58/140 R; 58/87

[58] Field of Search ..... 58/59, 86, 87, 139, 58/140 R

[56] References Cited

U.S. PATENT DOCUMENTS

| | | | |
|---|---|---|---|
| 3,846,974 | 11/1974 | Giger | 58/87 |
| 3,852,954 | 12/1974 | Bachmann | 58/59 |

*Primary Examiner*—Stanley J. Witkowski
*Attorney, Agent, or Firm*—Stevens, Davis, Miller & Mosher

[57] ABSTRACT

An improved extractable barrel-arbor for a watch movement is provided with first and second end cylindrical pivot bearing surfaces, and a central cylindrical surface containing a hook. The radius of the central surface is less than the radius of the first and second end cylindrical surfaces while the distance between the axis of the barrel-arbor and the outer hooking edge of the hook is equal to the radius of at least one of the first and second pivot bearing surfaces.

8 Claims, 2 Drawing Figures

FIG. 1
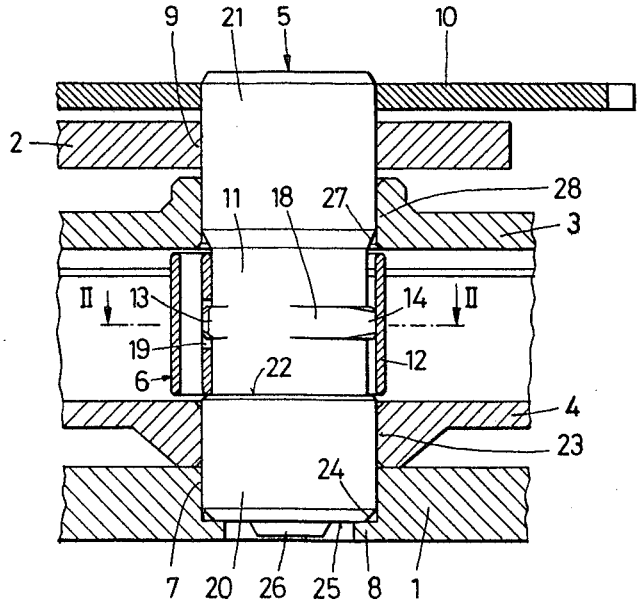
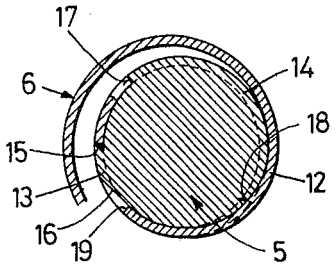
FIG. 2

EXTRACTABLE BARREL-ARBOR

BACKGROUND OF THE INVENTION

This invention relates to an extractable barrel-arbor for a watch movement of the type having a first end intended to pivot in a bottom plate, a second end intended to receive a ratchet wheel, a central cylindrical surface for supporting the inner end of a mainspring, and a hook projecting from the central cylindrical surface for fixing the mainspring inner end.

Most of the extractable barrel-arbors known until now, and especially those described in Swiss Pat. Nos. 16,961, 265,249, and 356,724, are solely intended to enable the barrel to pivot between two frame elements of the movement. The core is a separate part which is either secured to the arbor or freely engaged thereon. According to Swiss Pat. No. 265,249, the arbor comprises a central cylindrical bearing surface which is smaller in diameter than the pivot-bearing surfaces, but the former is engaged within the core.

French Disclosed Application No. 2,210,784 shows in FIG. 2 an extractable barrel-arbor, the use of which simplifies manufacture of the movement by dispensing with a separate core. Experience has shown, however, that in this known embodiment, the friction of the last turn of the mainspring is not sufficient to secure the arbor against inopportune axial displacement in the event of severe jolts. Furthermore, this extractable barrel-arbor design necessitates the use of a mainspring having its inner end bent into the shape of a hook, which complicates manufacture.

Another known arbor, disclosed in Swiss Pat. No. 134,172, is intended for hooking a mainspring and is designed so that it can easily be machined out of a round bar. However, the cylindrical support surface extending on each side of the hook is eccentric with respect to the pivoting surfaces. Moreover, the proposed arrangement would not be suitable for a barrel-arbor intended for a watch movement and designed so as to be extractable.

Conventional non-extractable barrel-arbors are machined by turning and milling, the milling operations being intended to form in the cylindrical outer surface of the core a hook which engages in a hole made at the inner end of the mainspring. The last turn of the mainspring, called the eye, rests partly against the milled surface and partly against the outer cylindrical surface of the core; and the two annular shoulders which axially limit these surfaces act, at least in certain cases, as axial stops by cooperating with the barrel-cover and the barrel-drum.

When the barrel is being fitted, the eye must be enlarged by inserting the core, and the spring must be fixed to the hook. Once this has been done, the barrel-cover is set in place, and the arbor can no longer be extracted without dismantling the barrel.

The provision of an extractable barrel-arbor having means for hooking the mainspring necessitates an arrangement which enables the hooking operations to be carried out when the barrel-cover is already in place and when the eye extends freely, approximately at the center of the drum, along a turn having a radius smaller than that of the cylindrical support surface of the arbor.

SUMMARY OF THE INVENTION

It is an object of this invention to provide an improved extractable barrel-arbor of the type initially described which avoids the drawbacks of prior art arbors and which can be fitted and extracted from the barrel easily and without any risk of a misstep.

To this end, in the extractable barrel-arbor according to the present invention, the improvement comprises a first cylindrical pivot-bearing surface coaxial with and adjacent to the central cylindrical surface at the end of the barrel-arbor intended to pivot in the bottom plate, the radius of this first cylindrical pivot-bearing surface being greater than that of the central cylindrical surface, a second cylindrical pivot-bearing surface coaxial with and adjacent to the central cylindrical surface at the end of the barrel-arbor intended to receive the ratchet wheel, the radius of this second cylindrical pivot-bearing surface being equal to or greater than that of the first cylindrical pivot-bearing surface, and an outer hooking edge of the hook situated at a radial distance from the axis of the barrel-arbor equal to the radius of the first cylindrical pivot-bearing surface.

BRIEF DESCRIPTION OF THE DRAWINGS

A preferred embodiment of the invention will now be described in detail with reference to the accompanying drawing, in which:

FIG. 1 is a partially sectional view of a barrel-driven watch movement comprising this embodiment, and FIG. 2 is a section taken on the line II—II of FIG. 1, showing the central portion of the arbor.

DETAILED DESCRIPTION OF PREFERRED EMBODIMENT

FIG. 1 shows two frame elements, a bottom plate 1 and a barrel-bar 2, which form part of a mechanical watch movement. Fitted between these two frame elements is a motor assembly comprising a barrel-drum 3, a barrel-cover 4, an arbor 5, and a mainspring 6. A circular opening 7 in the plate 1 forms a bearing for the arbor 5. The opening 7 is bounded on the side nearest the outer face of the plate 1 by a rim 8 which constitutes a stop limiting the axial displacement of the arbor 5. A circular opening 9 in the barrel-bar 2 enables the arbor 5 to pivot near the other end thereof. A ratchet wheel 10 extends above the outer face of the barrel-bar 2. As will be seen further on, the wheel 10 is driven onto the arbor 5. However, other means of securing the wheel 10 may also be used, e.g., riveting, or engaging the wheel 10 on a square provided at the end of the arbor 5.

The arbor 5 can be produced entirely by profile-turning. The central portion thereof exhibits a cylindrical surface 11, the axial length of which is slightly greater than the width of the mainspring 6; the surface 11 supports and guides the inner end of an eye 12. The arbor 5 comprises two elements projecting from the surface 11, viz., a hook 13 and, situated opposite thereto, a support rib 14 (FIG. 2). The hook 13 has an inclined hooking face 15 at the front and a plane ramp 16 at the rear. The rib 14 extends over an arc of somewhat more than 180°. The end of the rib 14 facing the hooking face 15 is bounded by a radial face 17, while the other end thereof is bounded by a spiral surface of transition 18 joining the cylindrical surface 11. Between the surfaces 17 and 18, the rib 14 is bounded by a cylindrically curved surface, the radius of which is the same as that of the outer lateral surface of the hook 13. The difference in radius between this outer lateral surface and the cylindrical surface 11 is approximately equal to the thickness of the main-spring 6. Furthermore, the hook 13 and the rib 14 are of the same width. A hole 19 at the inner end of the mainspring 6 is wider and longer than the hook 13. Thus, when the mainspring 6 is fixed to the arbor 5, its inner end rests radially against the surface 11, while along the remainder of the eye 12 the spring 6 rests against the rib 14.

The arbor 5 comprises a first cylindrical bearing surface 20 on one side of the cylindrical surface 11 and a second cylindrical bearing surface 21 on the other side. The radius of each of these surfaces 20 and 21 is equal to that of the outer surface of the rib 14 and of the hook 13, hence equal to the radial distance from the axis of the arbor 5 to the outer edge of the hooking face 15. The bearing surface 20 is situated at the end of the arbor 5 intended to be engaged in the barrel and to pivot in the plate 1, while the bearing surface 21 is situated at the end bearing the ratchet wheel 10. The bearing surface 20 is separated from the surface 11 by a flat annular shoulder 22. Its length is sufficient to enable it to engage first in a central aperture 23 of the barrel-cover 4 and then in the opening 7. As may be seen in the drawing, the first cylindrical bearing surface 20 is bounded on the side opposite the shoulder 22 by a frustoconical bevel 24, then by a flat annular shoulder 25, and lastly by a central nib 26.

The second cylindrical bearing surface 21 is joined to the surface 11 by a frustoconical bevel 27. Its axial length is such that when the arbor 5 is in place, the bearing surface 21 passes through a central aperture 28 of the barrel-drum 3, through the opening 9, and extends beyond the barrel-bar 2, the wheel 10 being driven onto the end of the bearing surface 21 beforehand. The bearing surfaces 20 and 21, the cylindrical support surface 11, and the surface portion 18 are all coaxial.

The manufacture of the arbor 5 requires only a minimal number of operations, for a round bar having the diameter of the bearing surfaces 20 and 21 can be used as the semi-finished starting material. It then suffices to machine the surface 11, by turning, on each side of the hook 13 and the rib 14, after which these two elements are finished by milling. All these operations can be carried out on the same machine-tool. The turned surfaces may be left rough, and the pivoting surfaces 20 and 21 need no subsequent burnishing operations such as are necessary if it is desired to obtain, starting from a turned surface, a surface quality ensuring suitable pivoting. Indeed, drawn surfaces are of better quality than turned surfaces, and what is more, since they represent the surfaces of maximum diameter, they are lapped better during polishing in the tumbling-drum.

However, in other embodiments of the invention, those portions of the arbor intended to pivot in the plate 1 and in the bar 2 might have different diameters from that of the first bearing surface 20 or of the second bearing surface 21. In that case, it would naturally be necessary for the diameters of the different pivot-bearing surfaces to decrease from the end bearing the ratchet wheel towards the end intended to be engaged in the barrel, and burnishing operations would still be needed according to the quality desired on the bearing surfaces obtained by turning.

Even in such an embodiment, however, the result would be an arbor formed in one piece with its means for hooking to the mainspring and capable of being extracted from the barrel and replaced without dismantling the frame. Moreover, the hooking of the mainspring would ensure that the arbor is held axially in place.

Extraction of the arbor 5, starting from the situation illustrated in FIG. 1, is carried out in a very simple manner. It suffices to turn the arbor 5 in the direction opposite to that of winding, hence counterclockwise as viewed in FIG. 2, then to pull it axially. When the flat ramp 16 engages under the end of the hole 19, the eye 12 is enlarged owing to the presence of the hook 13, and the hole 19 disengages from the latter. The enlargement of the eye 12 is sufficient for its diameter to become equal to that of the bearing surface 20, so that the arbor 5 can be extracted axially. Once the arbor 5 has been removed, the eye 12 coils up and occupies the center of the barrel in a free position. When the arbor 5 is replaced, first the nib 26 and then the outer edge of the shoulder 25 and the bevel 24 engage in the eye 12 and enlarge it. This enlargement is facilitated by a rotary movement imparted to the arbor 5, so that the bearing surface 20 engages in the eye 12, passes completely through it, and keeps it enlarged until it is supported by the hook 13 and the rib 14. When the arbor 5 reaches the position shown in the drawing, it suffices to continue to turn it clockwise until the front face 15 of the hook 13 is situated near the front end of the hole 19, whereupon the hole 19 engages the hook 13. The inner end of the eye 12 then rests against the surface 11. It will be seen that from that moment, any accidental axial displacement of the arbor 5 towards the barrel-bar 2 is blocked inasmuch as the end of the mainspring 6 resting against the surface 11 is pushed axially by the shoulder 22, while the portion of the eye 12 resting against the rib 14 comes up against the edge of the aperture 28.

What is claimed is:

1. In a watch movement having a bottom plate; a ratchet wheel; a main spring having one end forming an eye; and a barrel-arbor having a first end pivoting in said bottom plate, a second end attached to said ratchet wheel, a central cylindrical surface supporting an inner end of said eye of said mainspring, and a hook projecting from said central cylindrical surface for attaching said main spring eye to said barrel-arbor; the improvement in said barrel-arbor comprising:

a first cylindrical pivot-bearing surface coaxial with and adjacent to said central cylindrical surface at said first end, the radius of said first cylindrical pivot-bearing surface being greater than that of said central cylindrical surface, a second cylindrical pivot-bearing surface coaxial with and adjacent to said central cylindrical surface at said second end, the radius of said second cylindrical pivot-bearing surface being equal to or greater than that of said first cylindrical pivot-bearing surface, and an outer hooking edge of said hook situated at a radial distance from the axis of said barrel-arbor equal to said radius of said first cylindrical pivot-bearing surface.

2. A barrel-arbor in accordance with claim 1, further comprising a flat shoulder disposed perpendicular to the axis of said barrel arbor between said first cylindrical pivot-bearing surface and said central cylindrical surface.

3. A barrel-arbor in accordance with claim 1, further comprising an arcuate rib disposed on said central cylindrical surface on a level with and opposite said hook.

4. A barrel-arbor in accordance with claim 3, wherein said rib extends over an arc of somewhat more than 180° and joins said central cylindrical surface at at least one end of said rib along a spiral curve.

5. A barrel-arbor in accordance with claim 3, wherein said rib includes a cylindrical outer face having a radius equal to that of said first cylindrical pivot-bearing surface.

6. A barrel-arbor in accordance with claim 3, wherein said rib is of the same width as said hook.

7. A barrel-arbor in accordance with claim 1, further comprising a frustoconical, annular bevel bounding said first cylindrical pivot-bearing surface at the end thereof remote from said central cylindrical surface for facilitating engagement of said barrel arbor in said eye of said mainspring.

8. A barrel-arbor in accordance with claim 1, further comprising a flat shoulder at said first end adapted to rest against an inner rim bounding a bearing opening of said bottom plate.

* * * * *